US005603610A

United States Patent [19]

Kawaguchi et al.

[11] Patent Number: 5,603,610

[45] Date of Patent: Feb. 18, 1997

[54] CLUTCHLESS PISTON TYPE VARIABLE DISPLACEMENT COMPRESSOR

[75] Inventors: Masahiro Kawaguchi; Masanori Sonobe; Ken Suitou; Tomohiko Yokono, all of Kariya, Japan

[73] Assignee: Kabushiki Kaisha Toyoda Jidoshokki Seisakusho, Kariya, Japan

[21] Appl. No.: 361,111

[22] Filed: Dec. 21, 1994

Related U.S. Application Data

[63] Continuation-in-part of Ser. No. 255,043, Jun. 7, 1994.

[30] Foreign Application Priority Data

Dec. 27, 1993 [JP] Japan ..... 5-332145

[51] Int. Cl.[6] ..... F04B 1/29

[52] U.S. Cl. ..... 417/222.2; 417/295

[58] Field of Search ..... 417/222.1, 222.2, 417/295, 269

[56] References Cited

U.S. PATENT DOCUMENTS

| | | | |
|---|---|---|---|
| 4,669,272 | 6/1987 | Kawai et al. | 417/270 |
| 4,691,526 | 9/1987 | Kobayashi et al. | 417/269 |
| 4,801,248 | 1/1989 | Tojo et al. | 417/222.2 |
| 4,913,626 | 4/1990 | Terauchi | 417/222.2 |
| 4,963,074 | 10/1990 | Sanuki et al. | 417/270 |
| 5,000,666 | 3/1991 | Esaki | 417/222.2 |
| 5,032,060 | 7/1991 | Kobayashi et al. | 417/222 R |
| 5,105,728 | 4/1992 | Hayase et al. | 417/222.2 |
| 5,173,032 | 12/1992 | Taguchi et al. | 417/222.2 |
| 5,259,736 | 11/1993 | Terauchi | 417/270 |
| 5,370,503 | 12/1994 | Terauchi | 417/270 |

FOREIGN PATENT DOCUMENTS

| | | | |
|---|---|---|---|
| 0300831 | 1/1989 | European Pat. Off. . | |
| 0297514 | 1/1989 | European Pat. Off. . | |
| 0536989 | 4/1993 | European Pat. Off. . | |
| 362000674A | 1/1987 | Japan | 417/222.2 |
| 364056972A | 3/1989 | Japan | 417/222.2 |
| 402115576 | 4/1990 | Japan | 417/222.2 |
| 337378 | 2/1991 | Japan . | |
| 403160162 | 7/1991 | Japan | 417/222.2 |

*Primary Examiner*—Timothy Thorpe
*Assistant Examiner*—Peter G. Korytnyk
*Attorney, Agent, or Firm*—Brooks Haidt Haffner & Delahunty

[57] ABSTRACT

A compressor having an internal refrigerant gas passage selectively connected to and disconnected from an external refrigerant circuit separately provided from the compressor is described. The compressor has a plurality of pistons reciprocable in a plurality of cylinder bores in a housing for compressing gas supplied from the external refrigerant circuit to the internal refrigerant gas passage. A drive shaft is rotatably supported by the housing. A swash plate is supported on the drive shaft for integral rotation with inclining motion with respect to the drive shaft. The swash plate is movable between a maximum inclined angle and a minimum inclined angle. The disconnecting device disconnects the internal refrigerant gas passage from the external refrigerant circuit when the swash plate is at the minimum inclined angle. The internal refrigerant gas passage includes a first passage which connects a crank chamber and a suction chamber to deliver the refrigerant gas from the crank chamber to the suction chamber. A control valve detects the pressure in the first passage to control the inclined angle of the swash plate.

19 Claims, 7 Drawing Sheets

CLUTCHLESS PISTON TYPE VARIABLE DISPLACEMENT COMPRESSOR

CROSS REFERENCE TO RELATED APPLICATION

This application is a continuation-in-part of U.S. application Ser. No. 08/255,043 filed on Jun. 7, 1994, now allowed, entitled SWASH PLATE TYPE COMPRESSOR.

BACKGROUND OF THE INVENTION

1. Field of the Invention

The present invention relates to a clutchless piston type variable displacement compressor, and more particularly, to a clutchless piston type variable displacement compressor in which the inclined angle of the swash plate is controlled by utilizing the difference between the pressure in the crank chamber and the suction pressure to supply gas from a discharge pressure area to the crank chamber and to discharge the gas from the crank chamber to a suction pressure area, thereby adjusting the pressure in the crank chamber.

2. Description of the Related Art

In general, compressors are mounted in vehicles to supply compressed refrigerant gas to the vehicle's air conditioning system. To maintain air temperature inside the vehicle at a level comfortable for the vehicle's passengers, it is important to utilize a compressor whose displacement amount of the refrigerant gas is controllable. One known compressor of this type controls the inclined angle of a swash plate, tiltably supported on a drive shaft, based on the difference between the pressure in the crank chamber and the suction pressure, and converts the rotational motion of the swash plate to the reciprocal linear motion of each piston.

A conventional piston type compressor disclosed in U.S. Pat. No. 5,173,032 uses no electromagnetic clutch for the transmission and blocking of power between an external driving source and the drive shaft of the compressor. The external driving source is coupled directly to the drive shaft.

A clutchless structure with the driving source coupled directly to the drive shaft can eliminate shocks which are otherwise produced by the ON/OFF action of such a clutch. When such a compressor is mounted in a vehicle, the comfort inside the vehicle while driving can be improved. The clutchless structure can also contribute to reducing the overall weight and cost of the cooling system.

In such a clutchless system, the compressor runs even when no cooling is needed. With such type of compressors, it is important that when cooling is unnecessary, the discharge displacement be reduced as much as possible to prevent the evaporator from undergoing frosting. When no cooling is needed or there is a probability of causing frosting, the circulation of the refrigerant gas through the compressor and its external refrigeration circuit should simply be stopped. The compressor described in the aforementioned U.S. patent is designed to block the flow of gas into the suction chamber in the compressor from the external refrigeration circuit by the use of an electromagnetic valve.

In the compressor described above, when the circulation of the gas from the external refrigeration circuit to the suction chamber is blocked, the pressure in the suction chamber drops and the control valve responsive to that pressure opens fully. The full opening of the control valve allows the gas in the discharge chamber to flow into the crank chamber, which in turn raises the pressure inside the crank chamber. The gas in the crank chamber is supplied to the suction chamber. Accordingly, a short circulation path is formed which passes through the cylinder bores, the discharge chamber, the crank chamber, the suction chamber and back to the cylinder bores.

When the pressure in the suction chamber falls, the pressure in the cylinder bores falls, too, thus increasing the difference between the pressure in the crank chamber and the pressure in the cylinder bores. This pressure differential in turn minimizes the inclination of the swash plate which reciprocates the pistons. As a result, the discharge displacement becomes minimum. At this time, the driving torque needed by the compressor is minimized, thus reducing power loss as much as possible.

The aforementioned electromagnetic valve performs a simple ON/OFF action, and the checking of the gas flow from the external circuit to the suction chamber is executed spontaneously. Accordingly, the amount of gas led into the cylinder bores from the suction chamber decreases drastically. The rapid reduction in the amount of gas led into the cylinder bores quickly reduces the discharge displacement, causing the discharge pressure to fall quickly. Consequently, the torque needed by the compressor varies greatly in a short period of time.

Further, the gas flow from the external circuit to the suction chamber also restarts instantaneously. The amount of gas introduced into the cylinder bores from the suction chamber increases rapidly. The sharp increase in the amount of gas led into the cylinder bores quickly increases the discharge displacement, raising the discharge pressure quickly. Consequently, the torque needed by the compressor sharply rises in a short period of time. Such a torque variation stands in the way of achieving the primary purpose of the clutchless system to suppress the shocks that are producible by the ON/OFF action of a clutch.

In addition, the activation or deactivation of the electromagnetic valve according to the presence or absence of the cooling load should be carried out by detecting the temperature in the evaporator. The use of such a temperature sensing system inevitably increases the cost.

SUMMARY OF THE INVENTION

Accordingly, it is a primary objective of the present invention to provide a compressor which can alter the inclined angle of the swash plate in accordance with the presence or absence of a cooling load, without using the aforementioned temperature sensing system.

It is another objective of this invention to provide a compressor whose torque variation can be suppressed.

It is a further objective of this invention to provide a compressor which can set the inclined angle of the swash plate to the minimum angle to allow cooling to be manually stopped or to reduce the torque in an emergency.

To achieve the above objects, the compressor according to the present invention has an internal refrigerant gas passage selectively connected to and disconnected from an external refrigerant circuit provided separately from the compressor. The compressor has a plurality of reciprocable pistons for compressing gas supplied from the external refrigerant circuit to the internal refrigerant gas passage. A housing has a discharge chamber and a suction chamber. A crank chamber is defined in the housing. A plurality of cylinder bores are formed in the housing. Each cylinder bore communicates with the discharge chamber and the suction chamber and accommodates each piston. A drive shaft is rotatably supported by the housing. A swash plate is supported on the drive shaft for integral rotation with inclining motion with respect to the drive shaft. The swash plate is movable between a maximum inclined angle and a minimum inclined angle. Disconnecting means disconnects the internal refrigerant gas passage from the external refrigerant circuit when the swash plate is at the minimum inclined angle. The internal refrigerant gas passage includes a first passage that connects the crank chamber and the suction chamber to deliver the refrigerant gas from the crank chamber to the suction chamber. A control valve detects the pressure in the first passage to control the inclined angle of the swash plate.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

Figure 1:
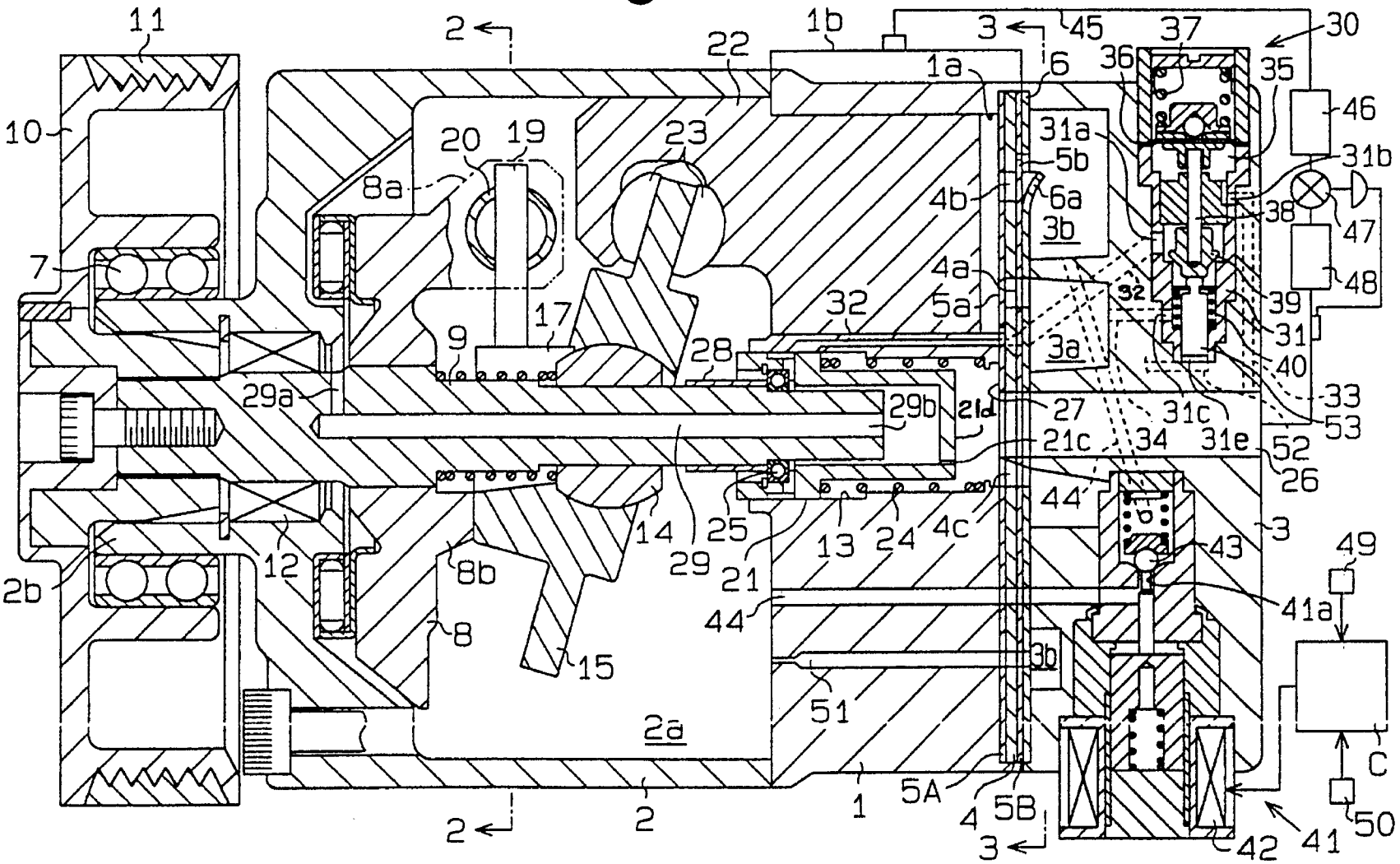
FIG. 1 is a cross-sectional side view of an overall compressor according to one embodiment of the present invention.

A compressor according to a preferred and illustrated embodiment of the present invention will now be described. FIG. 1 presents a cross-sectional view showing the overall compressor. The outline of the compressor will be discussed with reference to FIG. 1. A cylinder block 1 constitutes a part of the housing of the compressor. A front housing 2 is secured to the front end of the cylinder block 1. A rear housing 3 is secured to the rear end of the cylinder block 1 via a first plate 4, a second plate 5A, a third plate 5B and a fourth plate 6. The front housing 2 defines a crank chamber 2*a*. A drive shaft 9 is supported rotatably on the front housing 2 and the cylinder block 1. The front end of the drive shaft 9 protrudes outside the crank chamber 2*a* and is secured to a pulley 10. The pulley 10 is driven by the engine of a vehicle via a belt 11.

A support pipe 2*b* protrudes from the front end of the front housing 2 in such a way as to surround the front end of the drive shaft 9. The pulley 10 is supported via an angular bearing 7 on the support pipe 2*b*. Through the angular bearing 7, the support pipe 2*b* receives both the thrust load and radial load which act on the pulley 10. Between the front end of the drive shaft 9 and the front housing 2 is a lip seal 12 which prevents pressure leakage from the crank chamber 2*a*.

Figure 2:
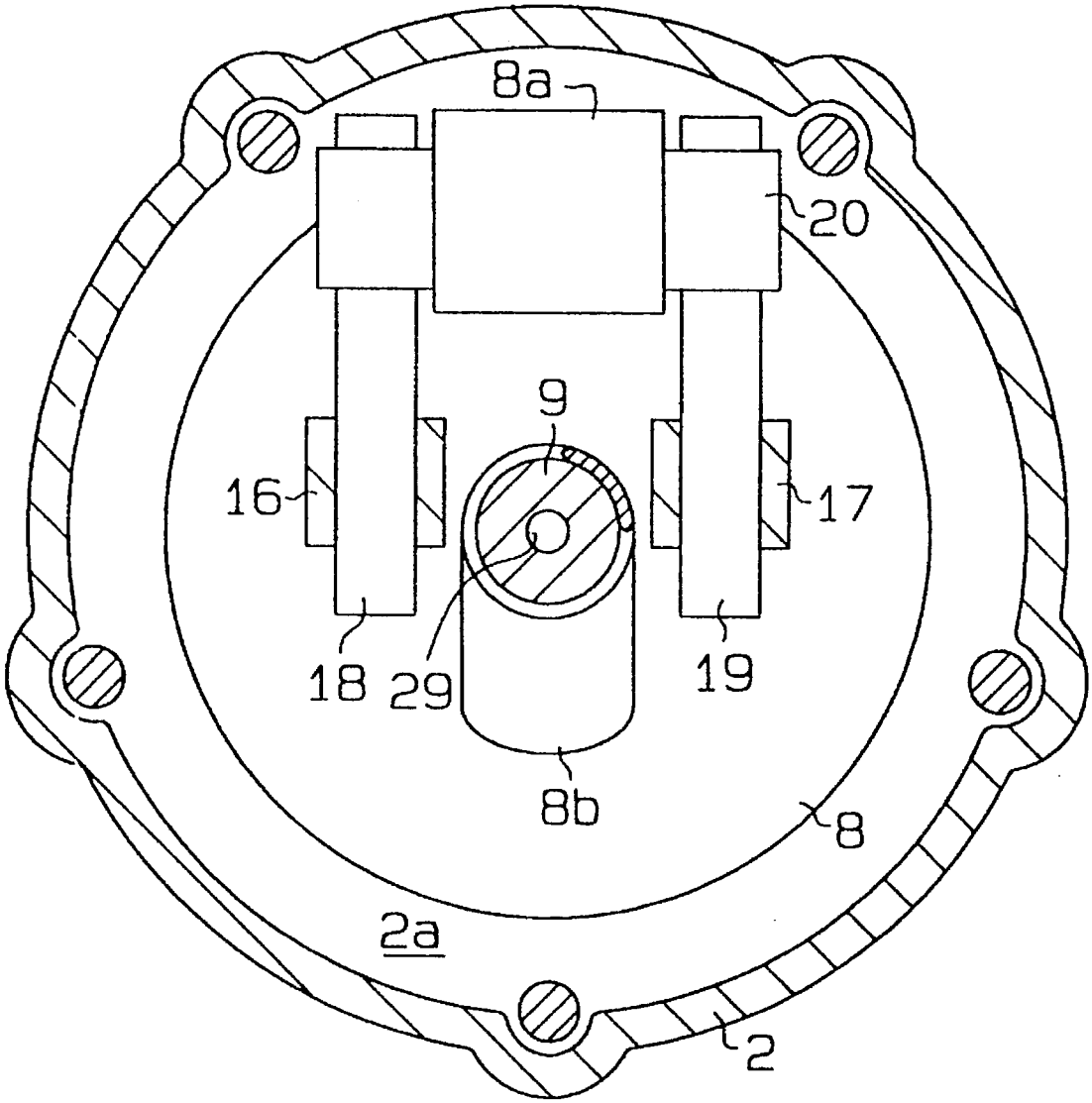
FIG. 2 is a cross-sectional view taken along the line 2—2 in FIG. 1.

A support 14 having a spherical surface is supported on the drive shaft 9 in a slidable manner. A swash plate 15 is supported on the support 14 in such a way as to be tiltable with respect to the drive shaft 9. As shown in FIG. 2, a pair of stays 16 and 17 are securely attached to the swash plate 15 and a pair of guide pins 18 and 19 are secured to the stays 16 and 17, respectively. A drive plate 8 is secured onto the drive shaft 9, with an arm 8*a* protruding from the drive plate 8.

A connector 20 extending in the direction perpendicular to the axis of the drive shaft 9 is rotatably supported on the arm 8*a*. The guide pins 18 and 19 are slidably fitted in both end portions of the connector 20. The swash plate 15 is tiltable about the support 14 with respect to the drive shaft 9 and is rotatable together with the drive shaft 9, the connector 20 on the arm 8*a*, and the guide pins 18 and 19.

A plurality of cylinder bores 1*a* are formed through the cylinder block 1 so as to connect to the crank chamber 2*a*. A single-head piston 22 is retained in each cylinder bore 1*a*. The rotational motion of the drive shaft 9 is transmitted to the pistons 22 via the drive plate 8, the swash plate 15 and shoes 23, causing the pistons 22 to move forward and backward in the associated cylinder bores 1*a* in accordance with the inclination of the swash plate 15.

Figure 3:
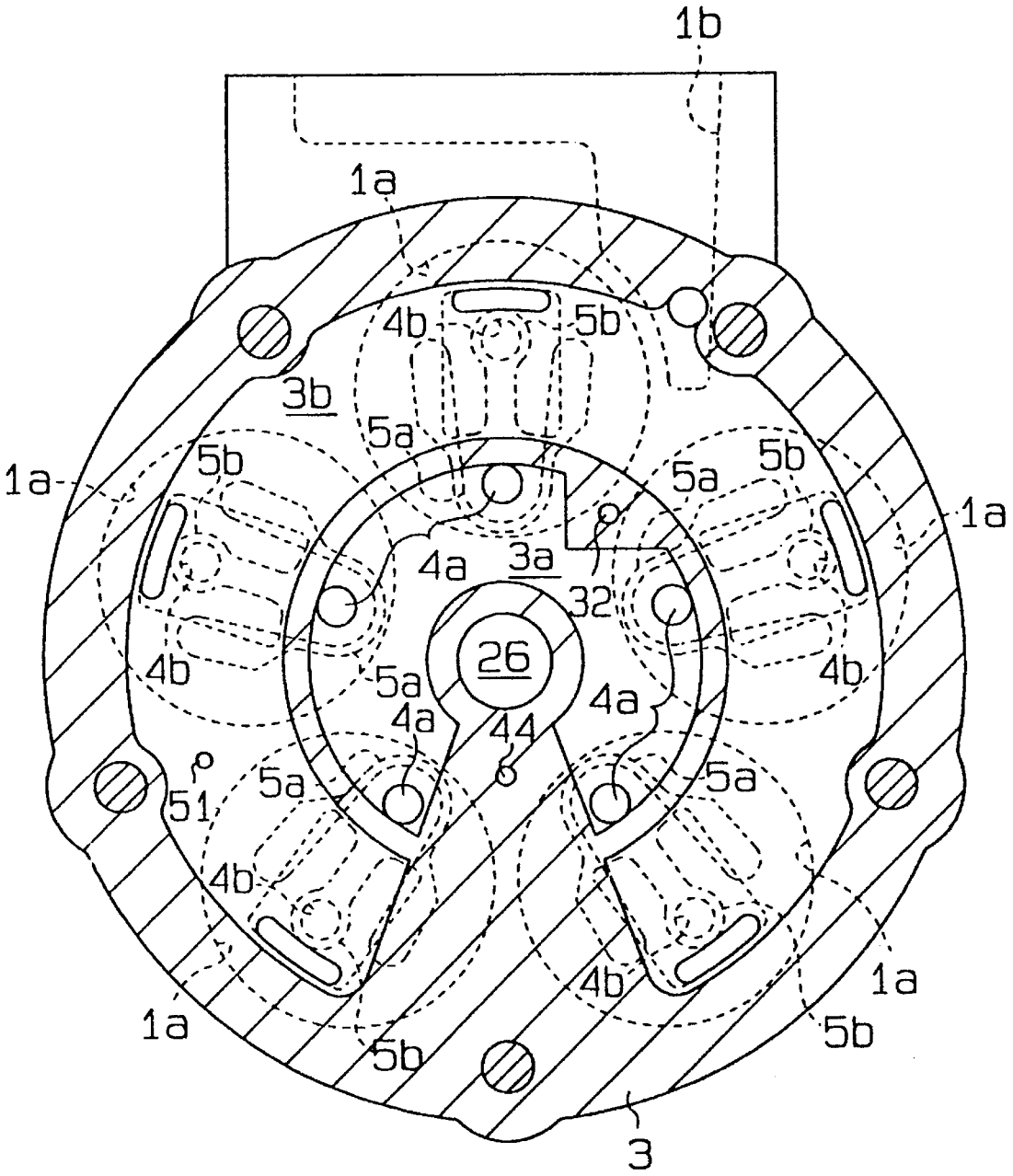
FIG. 3 is a cross-sectional view taken along the line 3—3 in FIG. 1.

As shown in FIGS. 1 and 3, a suction chamber 3*a* and a discharge chamber 3*b* are defined in the rear housing 3. Suction ports 4*a* and discharge ports 4*b* are formed in the first plate 4. Suction valves 5*a* are formed on the second plate 5A, and discharge valves 5*b* are formed on the third plate 5B. As the pistons 22 move forward, the refrigerant gas in the suction chamber 3*a* forces the suction valves 5*a* open. The refrigerant gas then passes through the suction ports 4*a* and enters the cylinder bores 1*a*. As the pistons 22 move backward, the refrigerant gases in the cylinder bores 1*a* force the discharge valves 5*b* open pass through the discharge ports 4*b* and enter the discharge chamber 3*b*. As each discharge valve 5*b* abuts on a retainer 6*a* on the third plate 6, the amount of opening of the associated discharge port 4*b* is restricted.

A description will now be given of the structure which supplies the refrigerant gas to each cylinder bore 1*a*.

Figure 4:
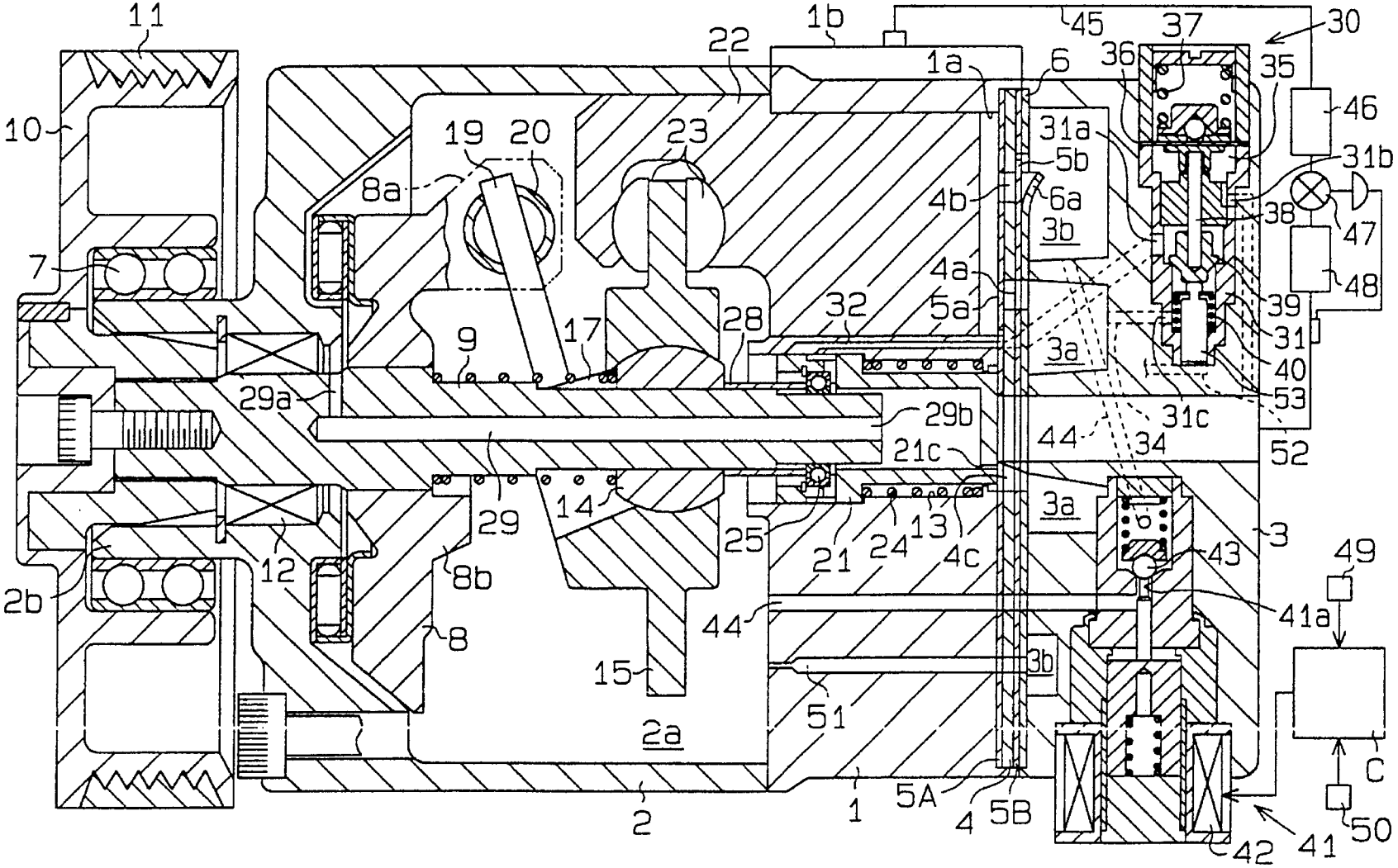
FIG. 4 is a cross-sectional side view of the whole compressor when its swash plate is at the minimum inclined angle.
Figure 5:
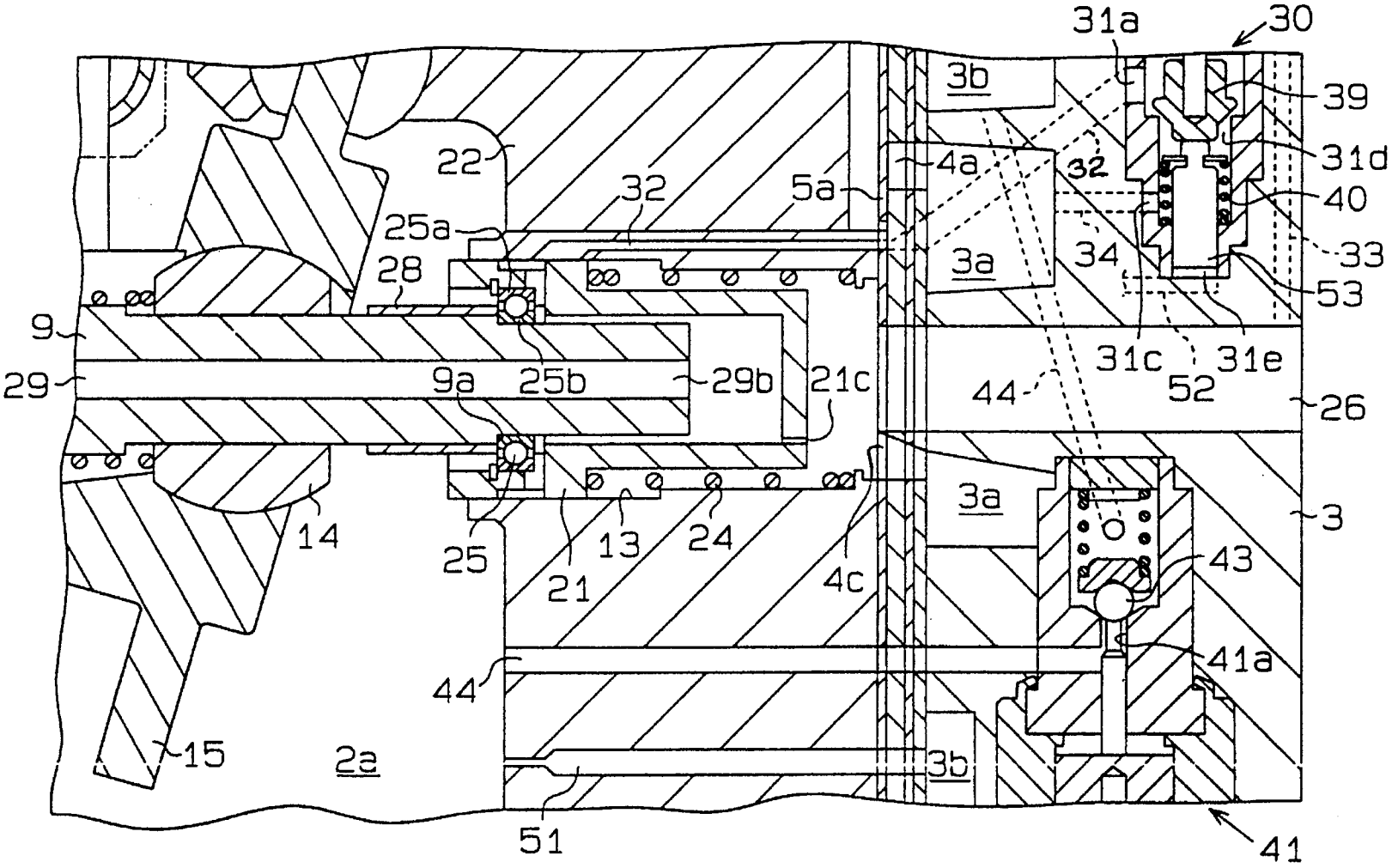
FIG. 5 is an enlarged cross-sectional view of essential parts showing the compressor when its swash plate is at the maximum inclined angle.

As shown in FIGS. 1, 4 and 5, a shutter chamber 13 is formed in the center portion of the cylinder block 1 and extends in the axial direction of the drive shaft 9. A cylindrical shutter member 21 having a lid or closed end 21*d* is slidably accommodated in the shutter chamber 13. Between the shutter member 21 and the inner wall of the shutter chamber 13 is a spring 24 which urges the shutter member 21 forward toward the support 14.

The rear end of the drive shaft 9 is fitted in the shutter member 21. A ball bearing 25 is located between the rear end of the drive shaft 9 and the inner wall of the shutter member 21. The ball bearing 25 receives the radial load and the thrust load which act on the drive shaft 9. The rear end of the drive shaft 9 is supported by the inner wall of the shutter chamber 13 via the ball bearing 25 and the shutter member 21. The ball bearing 25 has an outer race 25*a* secured to the inner wall of the shutter member 21, and an inner race 25*b* which is slidable along the outer surface of the drive shaft 9.

Figure 6:
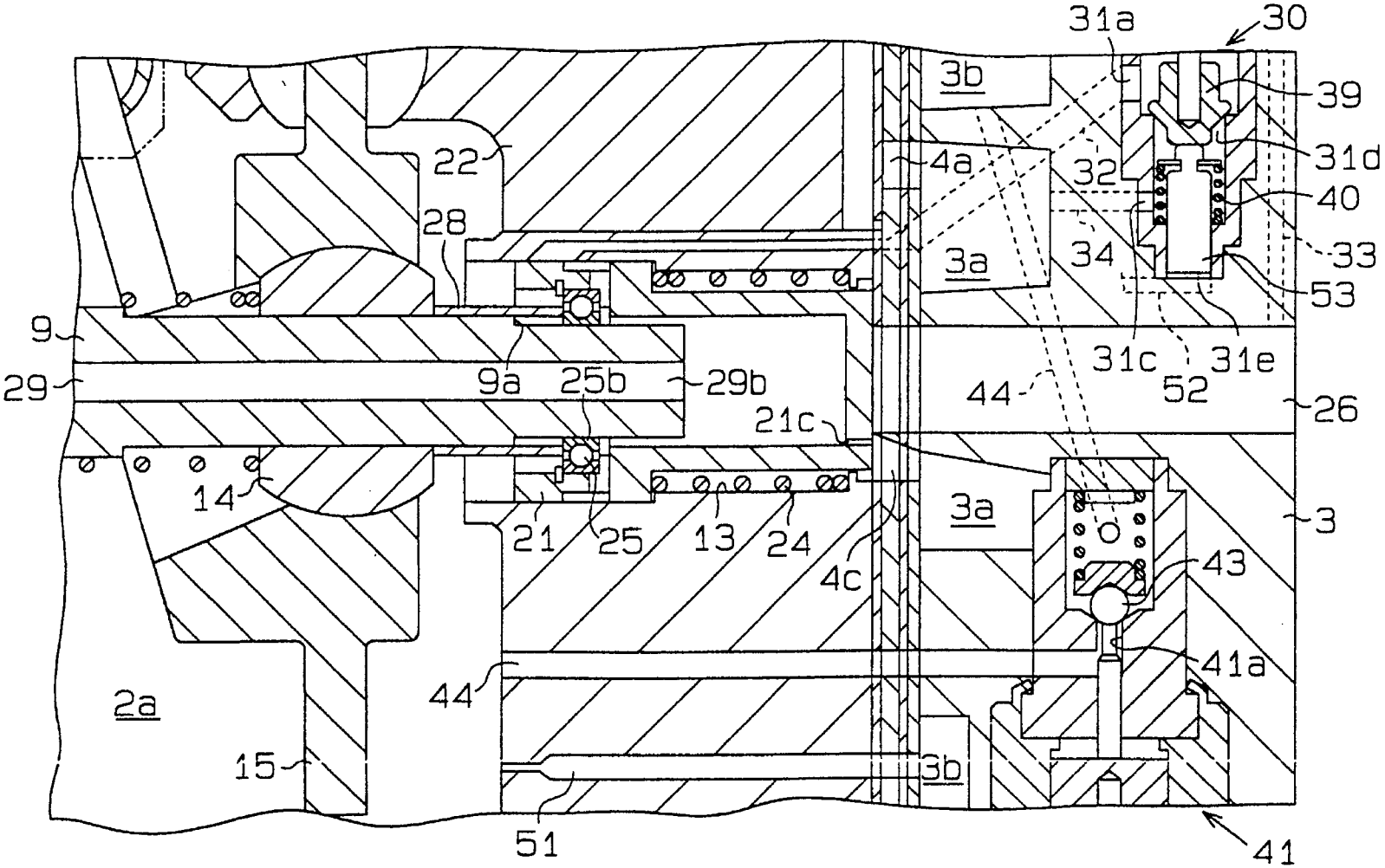
FIG. 6 is an enlarged fragmental cross-sectional view showing an energized solenoid and the swash plate at the minimum inclined angle.

As shown in FIG. 6, a step portion 9*a* is formed on the rear outer surface of the drive shaft 9. By the engagement of the inner race 25*b* of the ball bearing 25 with the step portion 9*a*, the movement of the ball bearing 25 toward the support 14 (i.e., the forward movement of the ball bearing 25) is inhibited. At the same time, the movement of the shutter member 21 toward the support 14 or the forward movement of the shutter member 21 is inhibited.

A suction passage 26 is formed in the center portion of the rear housing 3. This suction passage 26 communicates with the shutter chamber 13. A positioning surface 27 (see FIG. 1) is formed on the second plate 5A between the shutter chamber 13 and the suction passage 26. The distal closed end 21*d* of the shutter member 21 is adapted to abut against the positioning surface 27. As the distal end of the shutter member 21 abuts against the positioning surface 27, the movement of the shutter member 21 away from the support or the rearward movement of the shutter member 21 is restricted, and the communication between the suction passage 26 and the shutter chamber 13 is blocked.

A pipe 28 is slidably connected to the drive shaft 9 between the support 14 and the ball bearing 25. The front end of the pipe 28 is adapted to abut against the rear end face of the support 14, and the rear end of the pipe 28 is adapted to abut only against the inner race 25*b* of the ball bearing 25 without contacting the outer race 25*a*.

When the support 14 moves rearward, the support 14 abuts against the pipe 28, pressing the pipe 28 against the inner race 25*b* of the ball bearing 25. Consequently, the shutter member 21 moves toward the positioning surface 27 against the urging force of the spring 24 and the distal end 21*d* of the shutter member 21 abuts against the positioning surface 27. At this time the swash plate 15 is restricted to its minimum inclined angle. The minimum inclined angle of the swash plate 15 is slightly greater than zero degrees. Here, the inclined angle of the swash plate 15 would be zero degrees if the plane of the swash plate was perpendicular to the drive shaft 9.

When the inclined angle of the swash plate 15 becomes minimum, the shutter member 21 comes to a closed position to block the communication between the suction passage 26 and the shutter chamber 13 as shown in FIG. 6. The shutter member 21 is shifted leftward, as viewed in FIG. 6, between this closed position and an open position (see FIG. 5) away from the closed position, in response to the undulation of the swash plate 15. The maximum inclined angle of the swash plate 15 is restricted by the abutment of the swash plate 15 against a projection 8*b* of the drive plate 8, as shown in FIG. 1.

The suction chamber 3*a* communicates with the shutter chamber 13 via a connection passage 4*c* which penetrates through the individual plates. This connection passage 4*c* is disconnected from the suction passage 26 when the shutter member 21 comes to the closed position. The suction passage 26 constitutes an inlet for supplying the refrigerant gas into the compressor. The shutter member 21 therefore cuts off the passage of the refrigerant gas from the suction passage 26 to the suction chamber 3*a* at a downstream point from that inlet.

Figure 7:
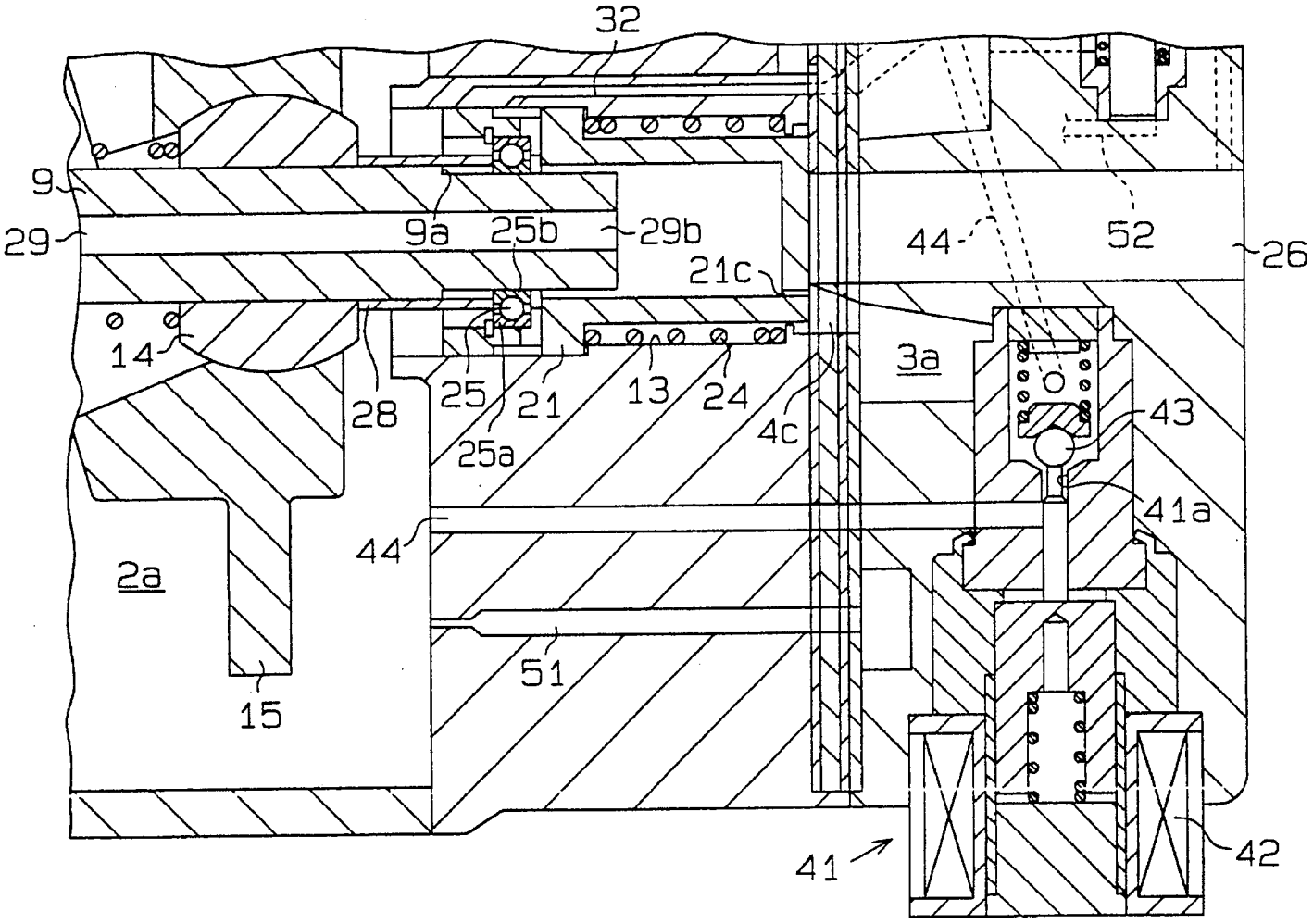
FIG. 7 is an enlarged fragmental cross-sectional view showing the solenoid deenergized and the swash plate at the minimum inclined angle.

As shown in FIG. 1, a passage 29 is formed in the drive shaft 9. The passage 29 has an inlet 29*a* open to the crank chamber 2*a* and an outlet 29*b* open to the interior of the shutter member 21. As shown in FIGS. 1, 4 and 5, a through hole 21*c* is formed in the closed rear end 21*d* of the shutter member 21. Even when the inclined angle of the swash plate 15 is minimum, this through hole 21*c* permits communication between the interior of the shutter member 21 and the connection passage 4*c*, as shown in FIGS. 6 and 7. At this time, therefore, the crank chamber 2*a* communicates with the suction chamber 3*a* via the passage 29, the interior of the shutter member 21, the through hole 21*c* and the connection passage 4*c*.

The stroke of the piston 22 changes in accordance with the difference between the pressure in the crank chamber 2*a* and the suction pressure in the associated cylinder bore 1*a*. In accordance with this pressure difference, the inclined angle of the swash plate 15 changes, thus changing the displacement of the compressor. The pressure in the crank chamber 2*a* is controlled by a displacement control valve 30 attached to the rear housing 3.

This displacement control valve 30 and the structure which is associated with this valve 30 will now be described with reference to FIGS. 1, 4 and 5. A valve housing 31 of the displacement control valve 30 has a first port 31*a*, a second port 31*b*, a third port 31*c* and a fourth port 31*e*. The first port 31*a* communicates with the interior of the shutter member 21 via a passage 32. The second port 31*b* communicates with the suction passage 26 via a passage 33. The third port 31*c* communicates with the suction chamber 3*a* via a passage 34. The fourth port 31*e* communicates with the discharge chamber 3*b* via a passage 52. Passage 52 is only partially illustrated in the drawings.

A suction pressure detection chamber 35 is connected to the second port 31*b*. The pressure in this detection chamber 35 acts against an adjust spring 37 via a diaphragm 36. The urging force of the adjust spring 37 is transmitted to the valve body 39 via the diaphragm 36 and a rod 38. The urging force of a return spring 40 acts on the valve body 39 via a pressure sensitive piston 53 disposed in the fourth port 31*e*. The urging force of the return spring 40 acts in the direction to open the valve hole 31*d* (see FIG. 5). The valve body 39 opens or closes the valve hole 31*d* in accordance with a change in suction pressure in the suction pressure detection chamber 35.

When the valve hole 31*d* is closed, the communication between the first port 31*a* and the third port 31*c* is blocked.

As mentioned above, the discharge pressure acts on the pressure sensitive piston 53. The direction of action of the discharge pressure is the same as that of the force of the return spring 40. The suction pressure of the gas supplied into the suction passage 26 falls due to a pressure loss caused by the long passage from the evaporator 48 shown in FIG. 1 to the suction passage 26. This pressure loss becomes greater as the discharge pressure becomes higher. The discharge pressure acting on the pressure sensitive piston 53 compensates for the suction pressure loss in the suction passage 26.

An electromagnetic valve 41 shown in FIG. 1 is attached to the rear housing 3. When a solenoid 42 of the electromagnetic valve 41 is energized or activated, a valve ball 43 closes a valve hole 41*a* as shown in FIG. 1. When the solenoid 42 is deenergized or deactivated, the valve ball 43 opens the valve hole 41*a*, as shown in FIG. 7. Therefore, the electromagnetic valve 41 selectively opens or blocks a passage 44 between the discharge chamber 3*b* and the crank chamber 2*a*.

As shown in FIG. 1, a restrictor passage 51 connects the discharge chamber 3*b* to the crank chamber 2*a*. An external refrigeration circuit 45 connects the suction passage 26, which supplies the refrigerant gas into the suction chamber 3*a*, to an exhaust port 1*b*, which permits the refrigerant gas in the discharge chamber 3*b* to be discharged. The external refrigeration circuit 45 has a condenser 46, an expansion valve 47 and an evaporator 48. The expansion valve 47 controls the flow rate of the refrigerant gas in accordance with a change in gas pressure on the outlet side of the evaporator 48.

A computer C shown in FIG. 1 controls the solenoid 42. More specifically, the computer C activates the solenoid 42 in response to the ON action of a start switch 49 for activating the air conditioning system or the OFF action of an accelerator switch 50 of the vehicle. The computer C deactivates the solenoid 42 in response to the OFF action of the start switch 49 or the ON action of the accelerator switch 50. In FIGS. 5 and 6, the solenoid 42 is activated, and the passage 44 is closed by the valve ball 43.

The function of the compressor with the passage 44 closed will be described below. When the cooling load is high and the pressure in the suction passage 26 is high, the pressure in the suction pressure detection chamber 35 rises due to increased pressure through the passage 33, and the amount of opening of the valve hole 31*d* by the valve body 39 increases as shown in FIG. 5. As the amount of opening of the valve hole 31*d* increases, the amount of the refrigerant gas flowing into the suction chamber 3*a* from the crank chamber 2*a* via the passage 32, the first port 31*a*, the valve hole 31*d*, the third port 31*c* and the passage 34 becomes larger. Even if the high-pressure refrigerant gas in the discharge chamber 3*b* has already entered the crank chamber 2*a* via the restrictor passage 51, the pressure in the crank chamber 2*a* falls. As the pressure in each cylinder bore 1*a* is also high, the difference between the pressure in the crank chamber 2*a* and the pressure in the cylinder bore 1*a* becomes larger. This increases the inclined angle of the swash plate 15 as shown in FIG. 5.

On the contrary, when the cooling load is low and the suction pressure is low, the amount of opening of the valve hole 31*d* by the valve body 39 decreases, thus reducing the amount of the refrigerant gas flowing into the suction chamber 3*a* from the crank chamber 2*a*. This increases the pressure in the crank chamber 2*a*. As the pressure in each cylinder bore 1*a* is low, the difference between the pressure in the crank chamber 2*a* and the pressure in the cylinder bore 1*a* increases. This reduces the inclined angle of the swash plate 15. When there is no cooling load and the suction pressure is very low, the valve body 39 closes the valve hole 31*d* as shown in FIG. 6.

When the solenoid 42 is deactivated by the OFF action of the start switch 49 or the ON action of the accelerator switch 50 in this embodiment, the valve ball 43 opens the valve hole 41*a*, opening the passage 44 as shown in FIG. 7. Under this condition, the refrigerant gas in the discharge chamber 3*b* rapidly flows into the crank chamber 2*a*. The pressure in the crank chamber 2*a* therefore rises quickly, thus rapidly decreasing the inclined angle of the swash plate 15.

As the inclined angle of the swash plate 15 decreases, the support 14, the pipe 28 and the ball bearing 25 move rearward and the distal end of the shutter member 21 approaches the positioning surface 27 through the rearward movement. Consequently, the cross-sectional area of the space extending from the suction passage 26 to the suction chamber 3*a* where the refrigerant gas passes decreases gradually. The amount of the refrigerant gas led into each cylinder bore 1*a* from the suction chamber 3*a* also decreases gradually, thus reducing the discharge displacement slowly. As a result, the discharge pressure gradually falls while the inclined angle of the swash plate 15 decreases quickly. Therefore, the torque on the drive shaft 9 does not greatly change in a short period of time.

When the distal end 21*d* of the shutter member 21 abuts against the positioning surface 27, the shutter member 21 blocks the communication between the external refrigeration circuit 45 and the suction chamber 3*a* as shown in FIG. 6. This inhibits the flow of the refrigerant gas into the suction chamber 3*a* from the external refrigeration circuit 45. Since the minimum inclined angle of the swash plate 15 is not zero degrees in this embodiment, the refrigerant gas is discharged to the discharge chamber 3*b* from the cylinder bores 1*a* even with the swash plate 15 positioned at the minimum inclined angle. Even when the swash plate 15 is at the minimum inclined angle, therefore, there are pressure differences among the discharge chamber 3*b*, the crank chamber 2*a* and the suction chamber 3*a*.

Under this condition, however, the crank chamber 2*a* is connected to the suction chamber 3*a* via the passage 29, the interior of the shutter member 21, the through hole 21*c* and the communication hole 4*c*. Therefore, a circulation path including the restriction passage 51, the crank chamber 2*a*, the passage 29, the interior of the shutter member 21, the through hole 21*c*, the communication hole 4*c*, the suction chamber 3*a* and the cylinder bores 1*a* is formed in the compressor. The refrigerant gas discharged into the discharge chamber 3*b* thus circulates along this circulation path and does not flow into the external refrigeration circuit 45. This prevents the evaporator 48 from undergoing frosting. The individual internal parts of the compressor are lubricated by a lubricating oil suspended in the refrigerant gas.

As the cross-sectional area of the through hole 21*c* in the circulation path is small, the pressure difference of the refrigerant gas before and after passing the through hole 21*c* is large. That is, the pressure of the refrigerant gas in the shutter member 21 before passing the through hole 21*c* is higher than that of the refrigerant gas which has passed the through hole 21*c*. This pressure difference ensures that a good seal is maintained between the shutter member 21 and the positioning surface 27. This inhibits the flow of the refrigerant gas into the suction chamber 3*a* from the external refrigeration circuit 45.

When the cooling load increases and the suction pressure rises with the suction passage 26 closed as shown in FIG. 6, this greased suction pressure reaches the detection chamber 35 through the suction passage 26 via the passage 33. As a result, the valve body 39 opens the valve hole 31*d* as shown in FIG. 5. Alternatively, when the start switch 49 is set on or the accelerator switch 50 is set off to activate the air conditioning system with the suction passage 26 closed as shown in FIG. 6, the solenoid 42 is activated, blocking the passage 44.

As mentioned above, there are pressure differences among the discharge chamber 3*b*, the crank chamber 2*a* and the gas suction chamber 3*a*. If the passage 44 is blocked and the valve hole 31*d* is closed by the valve body 39, under this condition the supply of the refrigerant gas to the crank chamber 2*a* from the discharge chamber 3*b* is stopped. As a result, the pressure in the crank chamber 2*a* approaches the suction pressure and the inclined angle of the swash plate 15 becomes greater, thus increasing the discharge displacement. In accordance with the increase in inclined angle, the shutter member 21 gradually moves away from the positioning surface 27, thus slowly increasing the cross-sectional area of the space between the suction passage 26 and the suction chamber 3*a* where the refrigerant gas passes due to the urging force of the spring 24. This gradually increases the amount of the refrigerant gas led into the cylinder bores 1*a* from the suction chamber 3*a*, and slowly increases the discharge displacement and the discharge pressure as a consequence. Accordingly, the torque on the drive shaft 9 does not change considerably in a short period of time.

The compressor described in the aforementioned U.S. Pat. No. 5,173,032 uses an electromagnetic valve to directly block the communication between the external refrigeration circuit and the suction chamber to thereby inhibit the flow of the refrigerant gas into the suction chamber from the external refrigeration circuit. This conventional compressor therefore suffers a large variation in discharge pressure, which would result in rapid change in torque. It is thus difficult to suppress the shocks originating from such a rapid torque change. According to the present invention, however, before the flow of the refrigerant gas to the suction chamber 3*a* from the external refrigeration circuit 45 is stopped, the discharge pressure is changed gradually based on the action of the shutter member 21 to ensure a gentle torque change. Consequently, rapid change in torque and the shocks originating from such torque change can be securely suppressed.

As the compressor described in the aforementioned U.S. Pat. No. 5,173,032 activates the electromagnetic valve based on the temperature in the evaporator, the evaporator is provided with a temperature sensing system. Since this embodiment detects the suction pressure by the displacement control valve 30 located upstream of the shutter member 21, however, the present compressor becomes more sensitive to a variation in cooling load. It is therefore unnecessary to provide any temperature sensing system in the evaporator, thus contributing to cost reduction.

The present invention is not limited to the above-described embodiment, but may be embodied in other forms without departing from the scope and spirit of this invention. For instance, the restrictor passage 51 in the above embodiment may be omitted, in which case the refrigerant gas should be supplied to the crank chamber 2*a* from the discharge chamber 3*b* by the blow-by gas that passes between each piston 22 and the associated cylinder bore 1*a*, when the passage 44 is closed.

A passage corresponding to the through hole 21*c* in the above-described embodiment may be provided in a member other than the shutter member 21, or the support 14 may be omitted and the swash plate 15 can be mounted directly on the drive shaft 9 in a tiltable manner.

To keep the communication between the crank chamber 2*a* and the suction chamber 3*a* without completely blocking this communication by means of the displacement control valve 30 when the inclined angle of the swash plate is minimum, a communication hole may be formed in the member which constitutes the displacement control valve 30 so that the circulation path includes this communication hole.

Therefore, the present examples and embodiments are to be considered as illustrative and not restrictive and the invention is not to be limited to the details given herein, but may be modified within the scope of the appended claims.

As used herein and in the appended claims, it should be understood that the "internal refrigerant gas passage" encompasses the overall passage provided by passages 29, 32, 34, 44 and 51. The "first passage" involves passages 29, 32 and 34. The "second passage" involves passage 44. The "connection passage" is the communication hole 4*c*. The "first regulating member" involves the step portion 9*a* which provides a limit stop. The "second regulating member" involves the positioning surface 27.

What is claimed is:

1. A compressor having an internal refrigerant gas passage selectively connected to and disconnected from an external refrigerant circuit separately provided from the compressor, said compressor having a plurality of reciprocable pistons for compressing gas supplied from the external refrigerant circuit to the internal refrigerant gas passage, said compressor comprising:

a housing having a discharge chamber and a suction chamber;

a crank chamber defined in the housing;

a plurality of cylinder bores formed in the housing, each cylinder bore communicating with the discharge chamber and the suction chamber and accommodating each piston respectively;

a drive shaft rotatably supported by the housing;

a swash plate supported on the drive shaft for integral rotation with the drive shaft and inclining motion with respect to the drive shaft, said swash plate being movable between a maximum inclined angle and a minimum inclined angle;

disconnecting means for disconnecting the internal refrigerant gas passage from the external refrigerant circuit when the swash plate is at the minimum inclined angle;

said internal refrigerant gas passage including a first passage for connecting the crank chamber and the suction chamber to deliver the refrigerant gas from the crank chamber to the suction chamber; and a control means for detecting a pressure in the first passage to control the inclined angle of the swash plate.

2. A compressor according to claim 1, wherein said control means includes a control valve for selectively opening and closing the first passage.

3. A compressor according to claim 2, wherein said disconnecting means is disposed downstream of a position where said control valve detects the pressure in the internal refrigerant gas passage.

4. A compressor according to claim 1, wherein said internal refrigerant gas passage further includes:

a second passage for connecting the discharge chamber and the crank chamber to deliver the refrigerant gas from the discharge chamber to the crank chamber; and a circulating path including the first and the second passages, said circulating path being formed upon disconnection of the external refrigerant circuit from the internal refrigerant gas passage.

5. A compressor according to claim 4 further comprising:

a suction passage for connecting the external refrigerant circuit and the internal refrigerant gas passage; and an exhaust port for connecting the discharge chamber to the external refrigerant circuit to deliver the refrigerant gas from the discharge chamber to the external refrigerant circuit.

6. A compressor according to claim 4 further comprising a restrictor passage for delivering the refrigerant gas from the discharge chamber to the crank chamber.

7. A compressor according to claim 4 further comprising a valve for selectively opening and closing the second passage in response to operational conditions of the compressor.

8. A compressor according to claim 7, wherein said valve includes an electromagnetic valve.

9. A compressor according to claim 8 further comprising a computer for controlling the electromagnetic valve in response to signals indicative of the operational conditions of the compressor.

10. A compressor according to claim 1 further comprising:

a suction passage for connecting the external refrigerant circuit and the internal refrigerant gas passage;

a connection passage for connecting the suction passage and the suction chamber; and said disconnecting means selectively opening and closing the connection passage.

11. A chamber according to claim 10, wherein said disconnecting means includes:

a shutter member movable along the internal refrigerant gas passage between a first position where the shutter member opens the connection passage and a second position where the shutter member closes the connection passage;

a spring for urging the shutter member toward the first position;

a first regulating member for regulating the shutter member at the first position in cooperation with the spring when the shutter member moves toward the first position; and a second regulating member for regulating the shutter member at the second position when the shutter member moves toward the second position.

12. A compressor according to claim 11, wherein said housing has a shutter chamber for accommodating the shutter member, said shutter chamber communicating with the suction passage and the connection passage.

13. A compressor to claim 12 further comprising:

said shutter member having a substantially cylindrical shape and a closed rear end;

said drive shaft having a front end and a rear end; and a front bearing and a rear bearing for respectively supporting the drive shaft at the front end and the rear end, said rear bearing being disposed within the shutter member.

14. A compressor according to claim 13 further comprising a pipe movable along the drive shaft, and wherein said pipe transmits the inclining motion of the swash plate to the shutter member via the rear bearing.

15. A compressor having an internal refrigerant gas passage selectively connected to and disconnected with an external refrigerant circuit separately provided from the compressor, said compressor having a plurality of reciprocable pistons for compressing gas supplied from the external refrigerant circuit to the internal refrigerant gas passage, said compressor comprising:

a housing having a discharge chamber and a suction chamber;

a crank chamber defined in the housing;

a drive shaft rotatably supported by the housing;

a plurality of cylinder bores defined in the housing, each cylinder bore communicating with the discharge chamber and the suction chamber and accommodating each piston;

a swash plate supported on the drive shaft for integral rotation with inclining motion with respect to the drive shaft, said swash plate being movable between a maximum inclined angle and a minimum inclined angle, respectively;

a suction passage for connecting the external refrigerant circuit and the internal refrigerant gas passage;

a connection passage for connecting the suction passage and the suction chamber;

a shutter member being capable of closing the connection passage for disconnecting the external refrigerant circuit from the internal refrigerant gas path when the swash plate is at the minimum inclined angle;

a first passage for connecting the crank chamber and the suction chamber to deliver the refrigerant gas from the crank chamber to the suction chamber;

a second passage for connecting the discharge chamber and the crank chamber to deliver the refrigerant gas from the discharge chamber to the crank chamber;

a circulating passage including the first and the second passages, said circulating passage being formed upon closing the connection passage by the shutter member; and a control means for detecting a pressure in the first passage to control the inclined angle of the swash plate.

16. A compressor according to claim 15 further comprising:

said shutter member being movable along the internal refrigerant gas passage between a first position where the shutter member opens the connection passage and a second position where the shutter member closes the connection passage;

a spring for urging the shutter member toward the first position;

a first regulating member for regulating the shutter member at the first position in cooperation with the spring when the shutter member moves toward the first position; and a second regulating member for regulating the shutter member at the second position when the shutter member moves toward the second position.

17. A compressor according to claim 16, wherein said housing has a shutter chamber for accommodating the shutter member, said shutter chamber communicating with the suction passage and the connection passage.

18. A compressor according to claim 17 further comprising:

said shutter member having a substantially cylindrical shape and a closed rear end; and said drive shaft having a front end and a rear end;

a front bearing and a rear bearing for respectively supporting the drive shaft at the front end and the rear end, said rear bearing being disposed within the shutter member.

19. A compressor according to claim 18 further comprising a pipe movable along the drive shaft, and wherein said pipe transmits the inclining motion of the swash plate to the shutter member via the rear bearing.

* * * * *

UNITED STATES PATENT AND TRADEMARK OFFICE

CERTIFICATE OF CORRECTION

PATENT NO. : 5,603,610

DATED : February 18, 1997

INVENTOR(S) : Kawaguchi et al

It is certified that error appears in the above-indentified patent and that said Letters Patent is hereby corrected as shown below:

Column 4, line 37, after "open" insert comma --,--.

Column 8, line 37, "greased" should read --increased--; line 38, after "35" change "through" to --from--.

Column 10, line 7, after "piston" insert comma --,--.

Column 11, line 49, after "piston" insert --, respectively--; line 54, delete "respectively;".

Column 12, line 5, change "path" to --passage--; line 13, change "passage" to --path--.

Signed and Sealed this

Twenty-third Day of September, 1997

Bruce Lehman

*Attest:*

BRUCE LEHMAN

*Attesting Officer*

*Commissioner of Patents and Trademarks*